US006935514B2

(12) United States Patent
Lackey et al.

(10) Patent No.: US 6,935,514 B2
(45) Date of Patent: Aug. 30, 2005

(54) DOWNROD DISPLAY

(75) Inventors: Robert W. Lackey, Hickory, NC (US); Robert Charles Beckmann, Vail, NC (US)

(73) Assignee: RWL Corporation, Hickory, NC (US)

( * ) Notice: Subject to any disclaimer, the term of this patent is extended or adjusted under 35 U.S.C. 154(b) by 0 days.

(21) Appl. No.: 10/776,885

(22) Filed: Feb. 11, 2004

(65) Prior Publication Data

US 2004/0217075 A1 Nov. 4, 2004

Related U.S. Application Data

(63) Continuation-in-part of application No. 10/137,665, filed on May 2, 2002.

(51) Int. Cl.[7] ..... A47F 5/00; A47F 7/00

(52) U.S. Cl. ..... 211/60.1; 211/49.1; 211/184

(58) Field of Search ..... 211/49.1, 60.1, 211/184, 11, 10, 59.2, 59.3, 70.1, 71.01; 345/905; 312/117, 124, 128

(56) References Cited

U.S. PATENT DOCUMENTS

| | | | | | |
|---|---|---|---|---|---|
| 1,054,487 | A | * | 2/1913 | Bagley | 206/762 |
| 1,640,971 | A | * | 8/1927 | Widen | 211/10 |
| 2,043,841 | A | * | 6/1936 | Stevens | 211/60.1 |
| 2,112,498 | A | * | 3/1938 | Lax | 312/352 |
| 2,439,790 | A | * | 4/1948 | Becker | 211/10 |
| 2,681,262 | A | * | 6/1954 | Vincent | 312/118 |
| 2,868,606 | A | * | 1/1959 | Stierna | 312/293.2 |
| 3,070,234 | A | * | 12/1962 | Deitchman | 211/10 |
| 3,385,451 | A | * | 5/1968 | Anderson | 211/60.1 |
| 3,499,540 | A | * | 3/1970 | Huncovsky | 211/60.1 |
| 3,643,807 | A | * | 2/1972 | Childs | 211/10 |
| 3,754,517 | A | * | 8/1973 | Hassel et al. | 108/61 |
| 3,886,348 | A | * | 5/1975 | Jonathan et al. | 362/127 |
| 4,765,492 | A | * | 8/1988 | Howard et al. | 211/55 |
| 4,775,057 | A | * | 10/1988 | Zingeser | 211/133.1 |
| 4,795,042 | A | * | 1/1989 | Klein et al. | 211/186 |
| 5,439,123 | A | * | 8/1995 | Nook | 211/187 |
| 5,497,888 | A | * | 3/1996 | Michaels et al. | 211/10 |
| 5,505,315 | A | * | 4/1996 | Carroll | 211/59.2 |
| 5,762,208 | A | * | 6/1998 | Yeh | 211/40 |
| 5,791,080 | A | * | 8/1998 | Hamano | 40/642.02 |
| 5,947,686 | A | | 9/1999 | Keyes | 416/61 |
| 6,068,139 | A | | 5/2000 | Brozak, Jr. | 211/59.2 |
| 6,164,215 | A | * | 12/2000 | Cook et al. | 108/60 |
| 6,520,355 | B1 | * | 2/2003 | Pritchard et al. | 211/187 |
| 6,758,349 | B1 | * | 7/2004 | Kwap et al. | 211/59.2 |
| 2002/0113030 | A1 | * | 8/2002 | Belisle | 211/85.7 |

* cited by examiner

*Primary Examiner*—Jennifer E. Novosad
(74) *Attorney, Agent, or Firm*—Charles L. Schwab; Nexsen Pruet, LLC

(57) ABSTRACT

A point of purchase display which is modular in design. A point of purchase display for use by a retailer to display ceiling fan downrods of various lengths in a slightly sloping upright position. Compartments for various lengths of downrods are placed side by side and one above the other to maximize use of floor space and for shopper convenience.

7 Claims, 2 Drawing Sheets

DOWNROD DISPLAY

RELATED APPLICATIONS

This application is a continuation-in-part of U.S. patent application Ser. No. 10/137,665, filed May 2, 2002.

TECHNICAL FIELD

This invention relates generally to the art of retail displays, and more particularly to a downrod display rack providing a customer-friendly display of various lengths of downrods for suspending ceiling fans.

BACKGROUND OF THE INVENTION

Overhead ceiling fans are suspended from ceilings or other overhead structures by downrods. Since ceiling heights are not uniform, it is customary for retail establishments catering to home builders and home improvement contractors to stock a large number of different length downrods.

Typical ceiling fan downrods are relatively long, slender, tubular items which are difficult to display due to the height required to display them properly and their instability when placed upright. If not displayed in an upright position, the items can not be optimally viewed and must be secured to prevent them from rolling. Also, when displayed horizontally, the downrods' narrow profile can interfere with consumers being able to readily identify which product is best suited for their needs and an excessive amount of floor space would be required. If the display area is high off the floor, then consumers may not be able to identify the products or the customer may find it necessary to remove the downrod to identify adaptability. Items such as fan extension downrods can also be difficult to load into and remove from a shelving space, especially if displayed horizontally, due to their length and the potential for rolling.

There are many variations in the length of downrods which gives rise to the need to display the downrods with distinguishing identification in a manner giving the self service customer access to the downrods in a point of purchase display.

Prior freestanding displays are inadequate in accommodating differing heights of downrods and take up excessive floor space. There is a need for a point of purchase display which addresses the shortcomings of the prior fan downrod point of purchase displays.

SUMMARY OF THE INVENTION

It is an object of this invention to provide a retail display for substantial quantities of fan downrods of many different lengths in which the downrods are segregated by length. It is a further object of this invention to provide a downrod display in which upstanding downrods are positioned at an angle which supports the downrod, optimizes viewing by customers and facilitates loading and unloading. It is a further object of this invention to provide a display which provides clear identification of the displayed downrods for the convenience of customers and stocking personnel.

These and other objects are accomplished by a display for displaying self service merchandise in quantity which includes an upright display rack which is made of plastic, wood, wire or other material, and which has adjustable compartments. The display may also include adjustable dividers within the compartments, a point-of-purchase identification channel on the front of the display, and an angled surface in each compartment to tilt merchandise to an optimal angle for improved stability, viewing, loading and unloading of merchandise.

BRIEF DESCRIPTION OF THE DRAWINGS

The invention and prior art is illustrated in the accompanying drawings in which.

DETAILED DESCRIPTION

In accordance with this invention, a display system for fan downrods is provided which allows for optimal viewing angle, effective product identification and maximum storage capability per unit of floor space. Various other advantages and features will become apparent from the following detailed description with attendant reference to the accompanying drawings.

Figure 1:
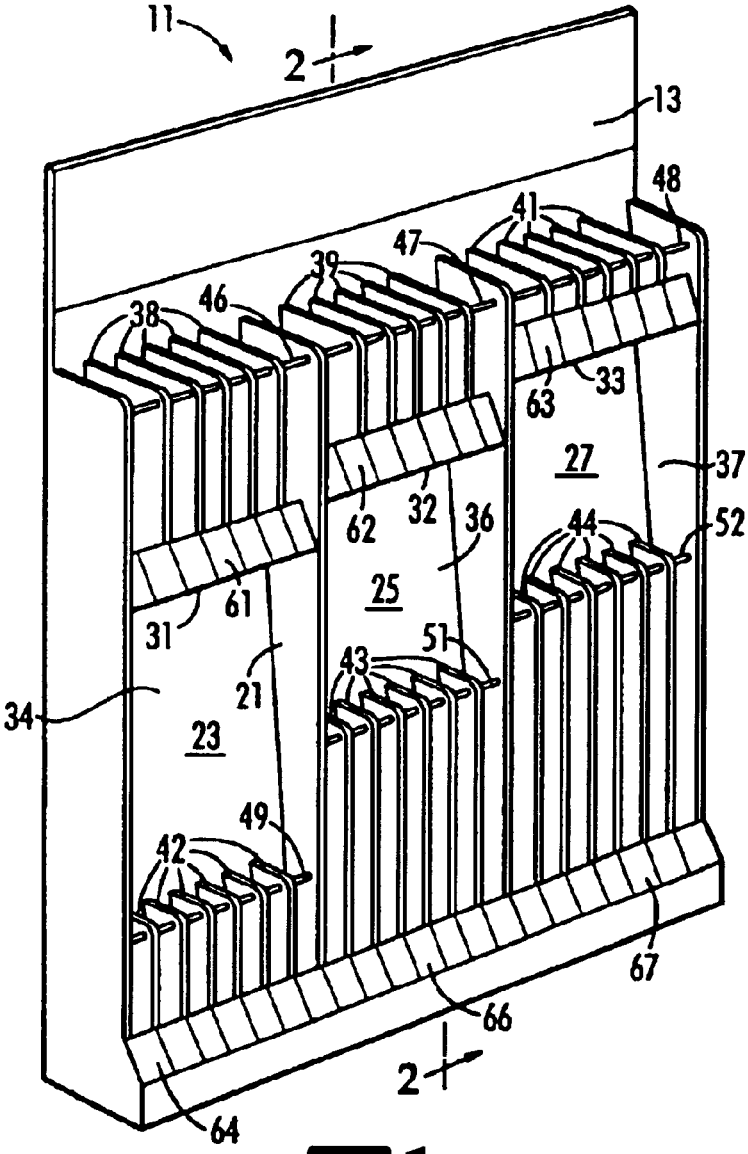
FIG. 1 is an front perspective view of the display in accordance with this invention.

FIG. 1 illustrates an upright open front display 11 as seen by a potential customer in a self service home improvement store. The top front of the display 11 is designed to accept a sign 13 across its lateral width for general product information for quick customer recognition of the nature of the displayed downrods. The display includes side by side open front modular sections 23, 25, 27 which can be added to or subtracted from as necessary to fit a designated space. The modular sections are joined by lining up the sections next to each other, as at 21. This modularity allows for easy assembly and maximum flexibility with regards to available space as well as accommodating as many products as required. One segment can be used for either different lengths of downrods or related products.

Figure 2:
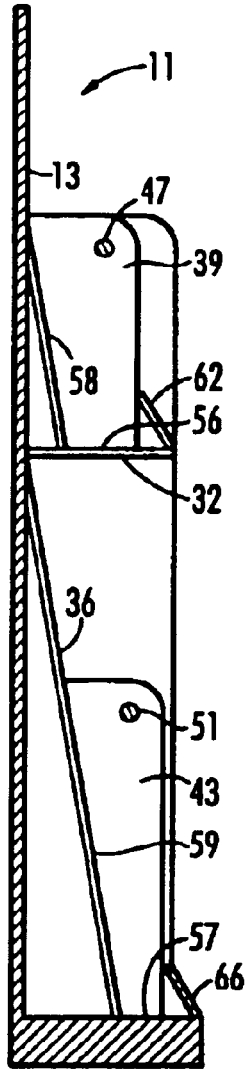
FIG. 2 is a side view taken on the line 2—2 in FIG. 1
Figure 3:
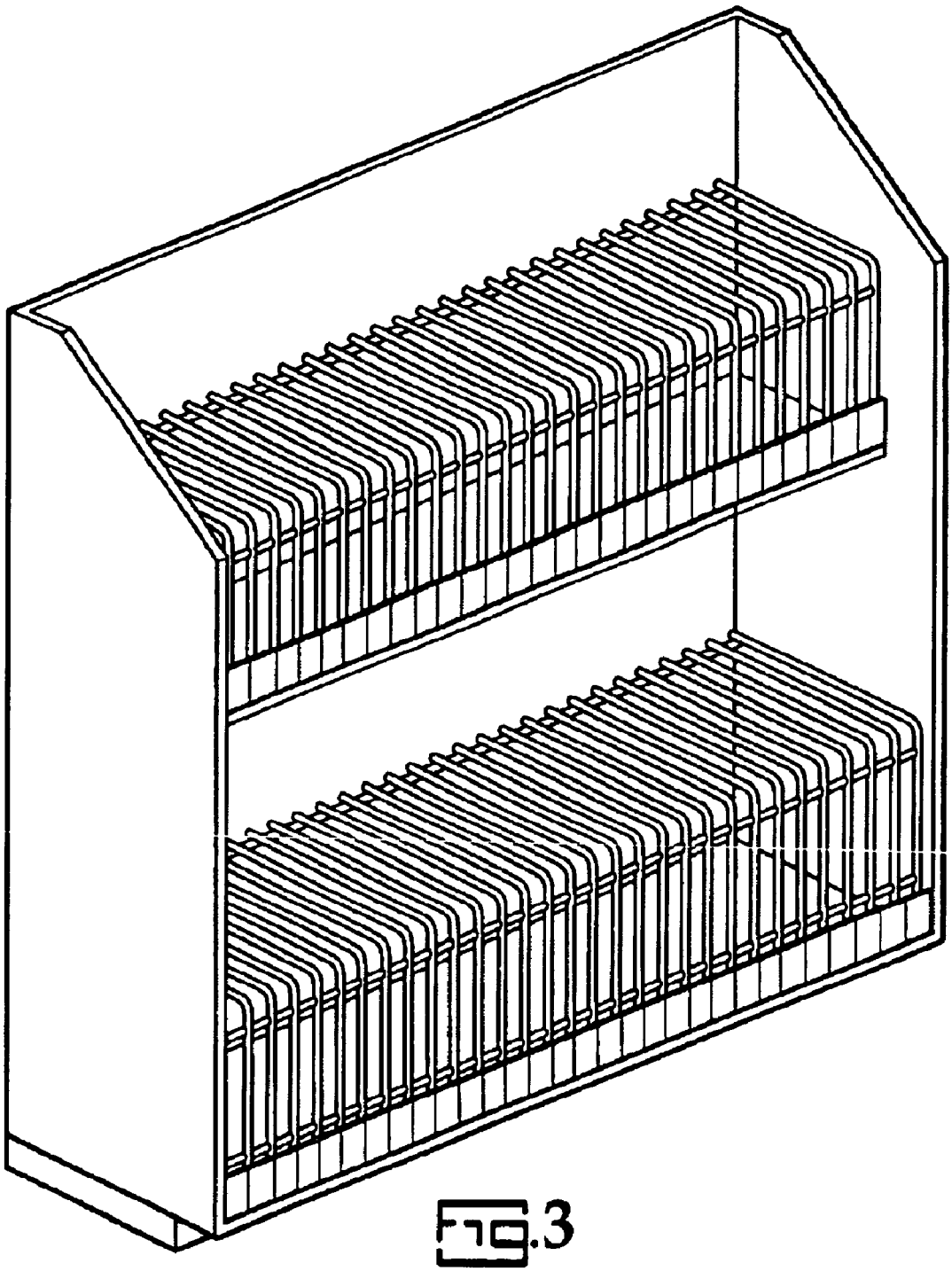
FIG.3 PRIOR ART
FIG. 3 is a perspective view of a prior art display for downrods.

Within the modular sections 23, 25, 27 are upper product bin or compartments 31, 32, 33 and lower product bins or compartments 34, 36, 37. The compartments 31, 32, 33, 34, 36, 37 have floors or bottoms on which the lower ends of the downrods rest. Floor 56 for compartment 32 and floor 57 for compartment 36 are show in FIG. 2. The compartments 31, 32, 33, 34, 36, 37 are subdivided by laterally spaced and adjustable dividers 38, 39, 41, 42, 43, 44, respectively, which are supported on rods 46, 47, 48, 49, 51, 52, respectively. The rear walls of the compartments 31, 32, 33, 34, 36, 37 slope back at a ten degree angle from vertical in order to stabilize the downrods, not shown, and to provide an optimal viewing angle for the customers. As shown in FIG. 2, the sloping rear walls 58, 59 of the compartments 32, 36, respectively, of section 25 are not coplanar, thereby reducing the floor space required for the display 11. The rear walls of the sections 23, 27 constructed in similar manner. The substantially upright position of the downrods, in which they are supported by the floors, rear walls and dividers, makes it easy to load and unload the compartments. Removal of a downrod does not cause movement or displacement of other downrods. The angle also prevents the downrod from tipping forward until an individual product is removed by a customer or by stocking personnel. The dividers allow downrods of the same or similar lengths to be segregated by color or other material distinction.

The front of the compartments 31, 32, 33, 34, 36, 37 are provided near their bottoms with laterally extending point-of-purchase product identification rails 61, 62, 63, 64, 66, 67 which accommodates inserts for product identification. The product identification rails 61, 62, 63, 64, 66, 67 slope rearward in a bottom to rear direction as viewed from the front of the display. Other information can be displayed, such as when a particular product is out-of-stock or a date by which more of the product can be expected. As illustrated in FIGS. 1 and 2, the compartment 33 for the shortest downrods is placed above the compartment 37 for the longest downrods. The compartment 32 for the next to shortest downrods is placed above the compartment 36 for the next to longest downrods. The compartment 34 is for the third from longest downrods and the compartment 31 above compartment 34 is for displaying the third from shortest downrods.

As shown in FIGS. 1 and 2, the identification rails 52, 56 extend laterally and slope rearwardly to facilitate reading by customers. FIG. 2 also illustrates the small footprint of the display. In a preferred embodiment, the base of the display 11 is only eighteen inches in front to rear depth. This shallowness provides more floor space for retailers, and when combined with the modular nature of the display 11, gives retailers maximum flexibility in choosing a location for the display. This can translate into greater sales for the products displayed by the invention, as retailers are more likely to utilize this display than the prior art displays.

This invention provides a novel and advantageous display for fan downrods. As the above description is exemplary in nature, variations will become apparent to those with skill in the art. Such variations may be embodied within the spirit and scope of this invention as defined by the following appended claims.

What is claimed is:

1. An upright open front display for ceiling fan downrods comprising:

a plurality of side by side sections with open fronts, an upper compartment and a lower compartment in each of said sections, each of said compartments including a floor and said compartments being unequal in vertical dimension to accommodate downrods of different lengths, an upward extending rear wall in each of said compartments sloping rearwardly from vertical in a bottom to top direction, and laterally spaced and adjustable dividers in each of said compartments; each of the compartments in each of the sections having a rod extending therein whereby the dividers in each compartment are supported on the respective rod with the dividers being adjustable within the respective compartment; said floors, rear walls and dividers serving to support downrods placed therein in a substantially upright position.

2. The display of claim 1 wherein said upper compartment in one of said sections is the shortest in vertical dimension and wherein said lower compartment in said one section is the tallest in vertical dimension.

3. The display of claim 1 wherein each section has an upper compartment which is shorter in vertical dimension than its lower compartment.

4. The display of claim 2 including laterally extending product identification rails at the bottom of each of said compartments, said rails sloping rearwardly in a bottom to top direction when viewed from the front of the display.

5. The display of claim 1 including a product identification sign extending laterally across the top of said sections.

6. The display of claim 1 wherein said rear wall of said upper compartment is not coplanar with said rear wall of the lower compartment of the corresponding section.

7. The display of claim 1 having three side by side sections, each section having an upper compartment that is shorter in vertical dimension than its lower compartment, said compartments being unequal in vertical dimension.

* * * * *